US011749911B2

(12) United States Patent
Mitsui et al.

(10) Patent No.: US 11,749,911 B2
(45) **Date of Patent: *Sep. 5, 2023**

(54) CONNECTOR

(71) Applicant: SUMITOMO WIRING SYSTEMS, LTD., Mie (JP)

(72) Inventors: Shohei Mitsui, Mie (JP); Norihito Hashimoto, Mie (JP); Motoki Kubota, Mie (JP); Keisuke Kanemura, Mie (JP); Wataru Yamanaka, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 85 days.

This patent is subject to a terminal disclaimer.

(21) Appl. No.: 17/474,207

(22) Filed: Sep. 14, 2021

(65) Prior Publication Data

US 2022/0085524 A1 Mar. 17, 2022

(30) Foreign Application Priority Data

Sep. 16, 2020 (JP) ..... 2020-155135

(51) Int. Cl.

| | |
|---|---|
| ***H01R 4/16*** | (2006.01) |
| ***H01R 13/639*** | (2006.01) |
| ***H01R 13/6473*** | (2011.01) |
| ***H01R 24/50*** | (2011.01) |
| ***H01R 12/72*** | (2011.01) |

(52) U.S. Cl.

CPC ..... *H01R 4/16* (2013.01); *H01R 12/724* (2013.01); *H01R 13/639* (2013.01); *H01R 13/6473* (2013.01); *H01R 24/50* (2013.01)

(58) Field of Classification Search

CPC ..... H01R 12/724; H01R 24/50

See application file for complete search history.

(56) References Cited

U.S. PATENT DOCUMENTS

| | | | | | |
|---|---|---|---|---|---|
| 2,689,337 | A * | 9/1954 | Burtt | H01R 13/432 | 439/874 |
| 3,077,513 | A * | 2/1963 | Felts | H01R 9/0518 | 174/750 |
| 3,085,222 | A * | 4/1963 | Watts | H01R 13/17 | 24/627 |
| 3,398,391 | A * | 8/1968 | Brishka | H01R 13/5202 | 439/589 |
| 3,513,438 | A * | 5/1970 | Henschen | H01R 13/432 | D13/133 |
| 3,613,052 | A * | 10/1971 | Maltais | H01R 13/428 | 439/872 |

(Continued)

FOREIGN PATENT DOCUMENTS

JP 2012-138201 A 7/2012

*Primary Examiner* — Neil Abrams

(74) *Attorney, Agent, or Firm* — Venjuris, P.C.

(57) ABSTRACT

A connector 10 includes an inner conductor terminal 11, an outer conductor terminal 13 for covering an outer periphery of the inner conductor terminal 11, and a dielectric 12 arranged between the inner conductor terminal 11 and the outer conductor terminal 13. The inner conductor terminal 11 includes a tubular terminal body 20 extending in a front-rear direction and projections (e.g. front projections 21 and rear projections 22) provided on the terminal body and to be locked to the dielectric 12. A plurality of the projections are provided at an interval in the front-rear direction.

5 Claims, 4 Drawing Sheets

(56) References Cited

U.S. PATENT DOCUMENTS

| | | | | | |
|---|---|---|---|---|---|
| 4,019,802 | A * | 4/1977 | Shannon | H01R 9/0518 | 439/585 |
| 4,070,751 | A * | 1/1978 | Hogendobler | H01R 9/0518 | 29/418 |
| 4,964,805 | A * | 10/1990 | Gabany | H01R 24/50 | 439/434 |
| 5,885,113 | A * | 3/1999 | Bricaud | H01R 13/41 | 439/733.1 |
| 7,070,440 | B1 * | 7/2006 | Zerebilov | H01R 24/40 | 439/582 |
| 10,594,057 | B2 * | 3/2020 | Kanemura | H01R 43/16 | |
| 10,644,416 | B2 * | 5/2020 | Kanemura | H01R 13/4362 | |
| 10,862,247 | B2 * | 12/2020 | Hashimoto | H01R 24/50 | |
| 2020/0274298 | A1 * | 8/2020 | Hashimoto | H01R 13/6594 | |
| 2020/0274299 | A1 * | 8/2020 | Hashimoto | H01R 13/6593 | |
| 2022/0085524 | A1 * | 3/2022 | Mitsui | H01R 12/724 | |

* cited by examiner

CONNECTOR

CROSS-REFERENCE TO RELATED APPLICATIONS

This application is based on and claims priority from Japanese Patent Application No. 2020-155135, filed on Sep. 16, 2020, with the Japan Patent Office, the disclosure of which is incorporated herein in their entireties by reference.

TECHNICAL FIELD

The present disclosure relates to a connector.

BACKGROUND

Japanese Patent Laid-open Publication Nos. 2020-113364 and 2012-138201 disclose a connector including a terminal inside a housing. The terminal of this connector includes an inner conductor terminal, an outer conductor terminal for covering the outer periphery of a connecting portion of the inner conductor terminal and a dielectric arranged between the inner conductor terminal and the outer conductor terminal.

In the connector of Japanese Patent Laid-open Publication No. 2020-113364, the connecting portion of the inner conductor terminal is formed into a hollow cylindrical shape, and a part of the outer conductor terminal for covering the connecting portion of the inner conductor terminal is also formed into a hollow cylindrical shape. Thus, an impedance between the inner conductor terminal and the outer conductor terminal is equalized. A pair of left and right projections are provided in a central part in a length direction of the connecting portion in this inner conductor terminal. When the inner conductor terminal is inserted into the dielectric from behind, the projections bite into the inner peripheral surface of the dielectric and the inner conductor terminal is locked to the dielectric.

SUMMARY

The inner conductor terminal of Japanese Patent Laid-open Publication No. 2020-113364 may be inclined with the projections as a fulcrum after being locked to the dielectric. If the inner conductor terminal is inclined, a disadvantage such as a change of the impedance between the inner conductor terminal and the outer conductor terminal may be caused.

Accordingly, the present disclosure aims to suppress the inclination of an inner conductor terminal in a dielectric.

The present disclosure is directed to a connector with an inner conductor terminal, an outer conductor terminal for covering an outer periphery of the inner conductor terminal, and a dielectric arranged between the inner conductor terminal and the outer conductor terminal, wherein the inner conductor terminal includes a tubular terminal body extending in a front-rear direction and projections provided on the terminal body and to be locked to the dielectric, and a plurality of the projections are provided at an interval in the front-rear direction.

According to the present disclosure, it is possible to suppress the inclination of an inner conductor terminal in a dielectric.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
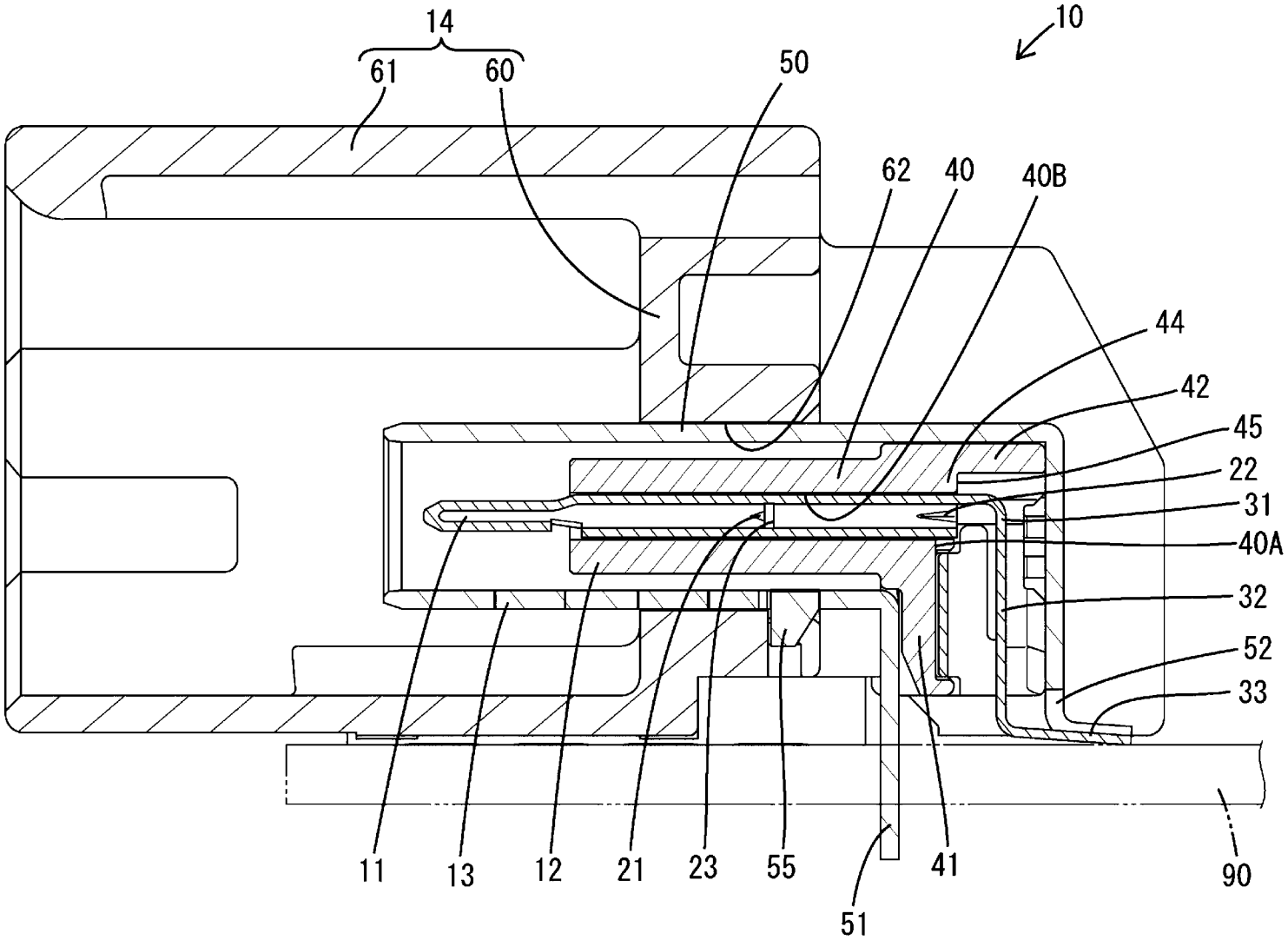
FIG. 1 is a side view in section of a connector according to one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

(1) The connector of the present disclosure includes an inner conductor terminal, an outer conductor terminal for covering an outer periphery of the inner conductor terminal, and a dielectric arranged between the inner conductor terminal and the outer conductor terminal, wherein the inner conductor terminal includes a tubular terminal body extending in a front-rear direction and projections provided on the terminal body and to be locked to the dielectric, and a plurality of the projections are provided at an interval in the front-rear direction.

According to this connector, the terminal body of the inner conductor terminal is locked to the dielectric at a plurality of positions spaced apart in the front-rear direction. Therefore, the inner conductor terminal is less likely to be inclined in the dielectric.

(2) Preferably, a rear projection is exposed on a rear end of the inner conductor terminal, the rear projection being the projection arranged at a rearmost position, out of the plurality of projections provided at an interval in the front-rear direction.

According to this configuration, the inner conductor terminal can be press-fit into the dielectric by pushing the rear projection exposed on the rear end of the inner conductor terminal by a jig or the like. That is, the rear projection can function as a pressing surface. Thus, a configuration can be simplified as compared to a configuration formed with a part having a pressing surface separately from the rear projection.

(3) Preferably, the dielectric has a reference surface aligned in position with a rear surface of the rear projection in the front-rear direction in a state where the inner conductor terminal is locked.

According to this configuration, in locking the inner conductor terminal by press-fitting the inner conductor terminal into the dielectric, the inner conductor terminal can be easily positioned in a press-fitting direction by pushing the jig until a surface of the jig pushing the rear projection butts against the reference surface.

(4) Preferably, the rear projection is formed by causing a part of the terminal body to project radially outwardly.

According to this configuration, since the rear projection can be formed by bending and raising a part of the terminal body, the rear projection is easily formed.

(5) Preferably, the inner conductor terminal includes a bent portion connected to a rear end of the terminal body and bent to cover a rear opening of the terminal body, and the rear projection is provided to protrude on both sides across the bent portion in a back view.

According to this configuration, since the rear projection can be pressed from both sides across the bent portion, the posture of the inner conductor terminal is easily stabilized and the inner conductor terminal is easily press-fit in the process of press-fitting the inner conductor terminal into the dielectric.

Details of Embodiment of Present Disclosure

A specific example of the present disclosure is described below with reference to the drawings. Note that the present invention is not limited to these illustrations and is intended to be represented by claims and include all changes in the scope of claims and in the meaning and scope of equivalents.

EMBODIMENT

A connector 10 installed on a board 90 is illustrated in one embodiment. Note that, in the following description, a side to be connected to an unillustrated mating terminal is referred to as a front side and an opposite side is referred to as a rear side. Further, a side of the connector 10 where the board 90 is arranged is referred to as a lower side and an opposite side is referred to as an upper side. Further, a lateral direction viewed from a front side is referred to as a lateral direction.

Figure 2:
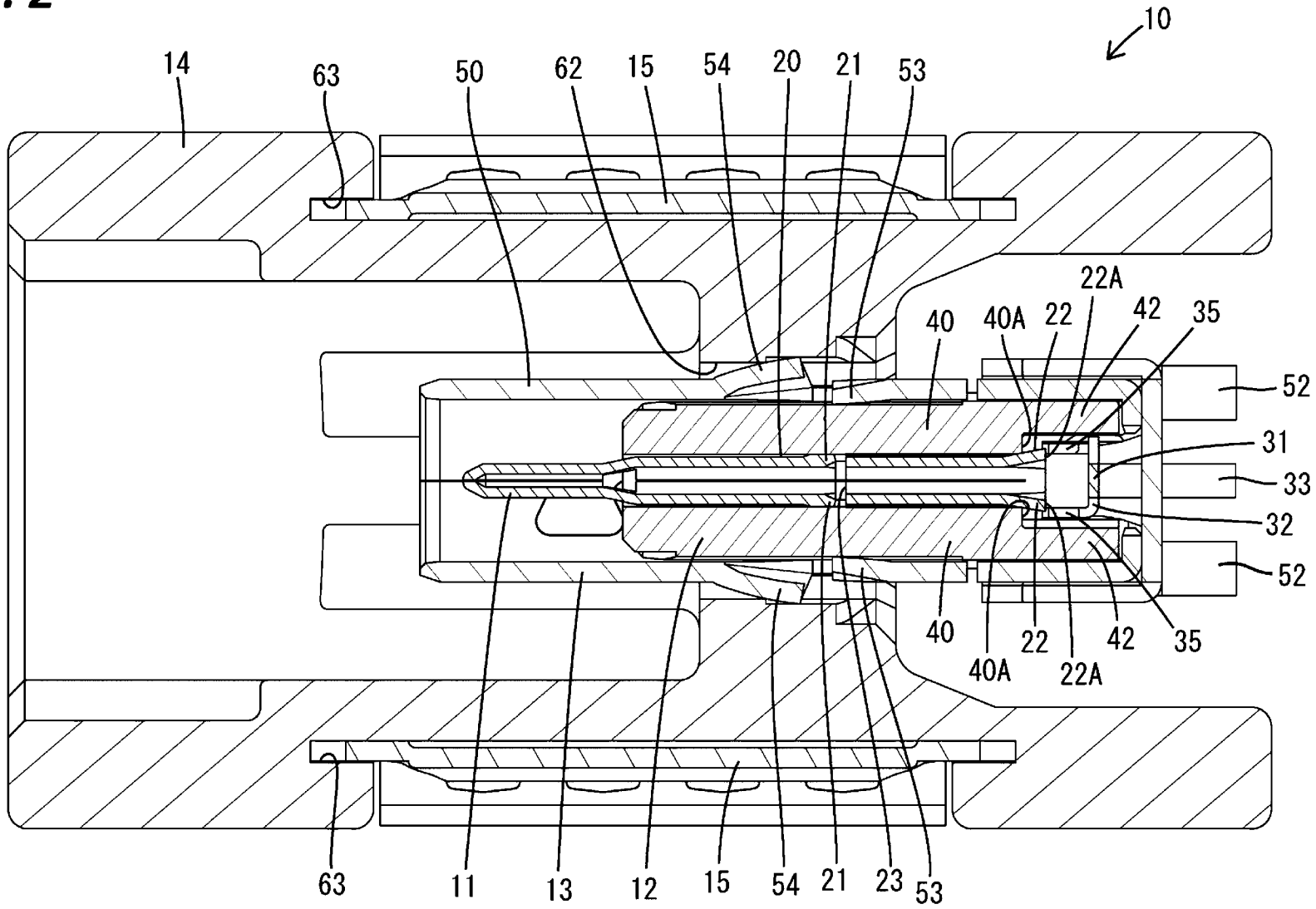
FIG. 2 is a plan view in section of the connector according to the one embodiment.

As shown in FIGS. 1 and 2, the connector 10 includes an inner conductor terminal 11, a dielectric 12, an outer conductor terminal 13, a housing 14 and mounting members 15.

Figure 3:
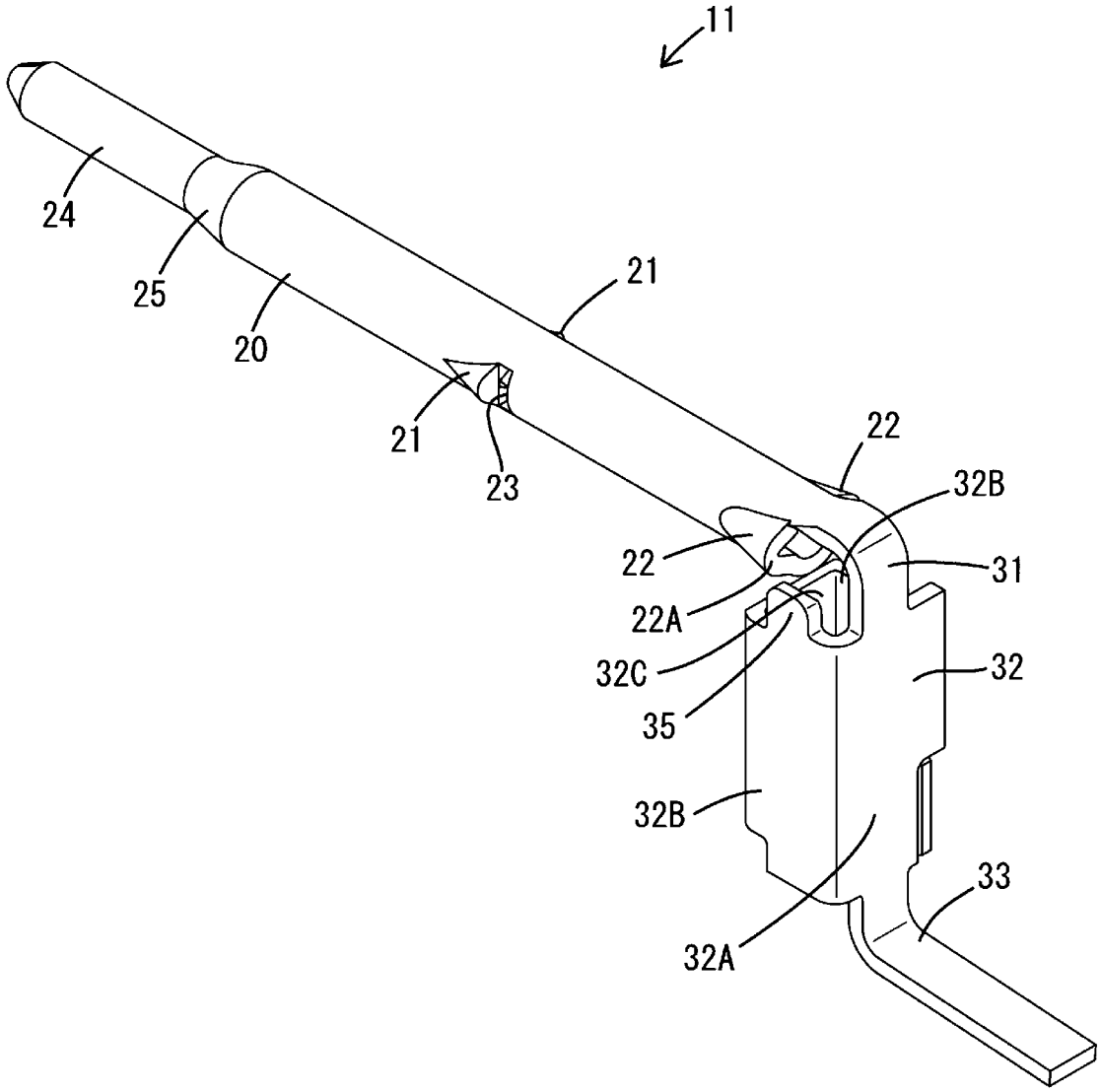
FIG. 3 is a perspective view of an inner conductor terminal.

The inner conductor terminal 11 is formed, such as by bending a metal plate. As shown in FIG. 3, the inner conductor terminal 11 includes a terminal body 20. The terminal body 20 is in the form of a tube, particularly a hollow cylinder, long in a front-rear direction. The terminal body 20 includes front projections 21 and rear projections 22. The front and rear projections 21, 22 correspond to examples of "projections". The front and rear projections 21, 22 are provided on the terminal body 20 while being spaced apart from each other in the front-rear direction. The front and rear projections 21, 22 are provided on both left and right sides of the terminal body 20 and project laterally outwardly of the terminal body 20.

The front projections 21 are arranged in a central part in the front-rear direction of the terminal body 20. The terminal body 20 is formed with slits 23 behind the front projections 21. The front projection 21 is formed by bending and raising a part of the terminal body 20 in front of the slit 23 outwardly. A front edge part of the slit 23 serves as the rear end of the front projection 21. The front projection 21 is shaped to expand in a direction away from an axis center of the terminal body 20 toward a rear side.

The rear projections 22 are arranged on the rear end of the terminal body 20. The rear projections 22 are formed by bending and raising both left and right sides of the rear end of the terminal body 20. The rear projection 22 is shaped to expand in the direction away from the axis center of the terminal body 20 toward the rear side. A projecting end in the lateral direction of the rear projection 22 projects further laterally outward than that of the front projection 21. The rear ends of the rear projections 22 are shaped by arcuately curving both left and right parts of the rear end of the terminal body 20 toward both left and right sides. The front and rear projections 21, 22 are respectively locked to the inner peripheral surface of the dielectric 12.

The inner conductor terminal 22 includes a tab portion 24 and a guiding portion 25. The tab portion 24 is arranged in front of the terminal body 20 and to be connected to the mating terminal. The tab portion 24 is in the form of a hollow cylinder having a smaller outer diameter than the terminal body 20. A front end part of the tab portion 24 is tapered to have the outer diameter gradually reduced toward a front side. The guiding portion 25 is arranged between the tab portion 24 and the terminal body 20 and connected to the rear end of the tab portion 24 and the front end of the terminal body 20. The guiding portion 25 is tapered to have an outer diameter gradually reduced toward the front side.

The inner conductor terminal 11 includes a bent portion 31, a rectangular tube portion 32, a board connecting portion 33 and projecting portions 35. The bent portion 31 has a base end connected to an upper part of the rear end of the terminal body 20, extends rearward, and is bent at a right angle to extend downward. A lateral width of the bent portion 31 is constant in an extending direction of the bent portion 31. The aforementioned rear projections 22 project on both left and right sides across the bent portion 31 in a back view (see FIG. 4).

The rectangular tube portion 32 is in the form of a rectangular tube open in a vertical direction. The rectangular tube portion 32 includes a rear plate portion 32A, both left and right side plate portions 32B and a front plate portion 32C. The upper end of the rear plate portion 32A is connected to the lower end of the bent portion 31. In the lateral direction, a width of the rear plate portion 32A is larger than that of the bent portion 31. The projecting portions 35 project upward from the upper ends of the both left and right side plate portions 32B.

The board connecting portion 33 is a part to be connected to a conductive path of the board 90. The board connecting portion 33 extends downward from the lower end of the rear plate portion 32A of the rectangular tube portion 32 and is bent to extend rearward. In the lateral direction, a width of the board connecting portion 33 is smaller than that of the rear plate portion 32A.

Figure 4:
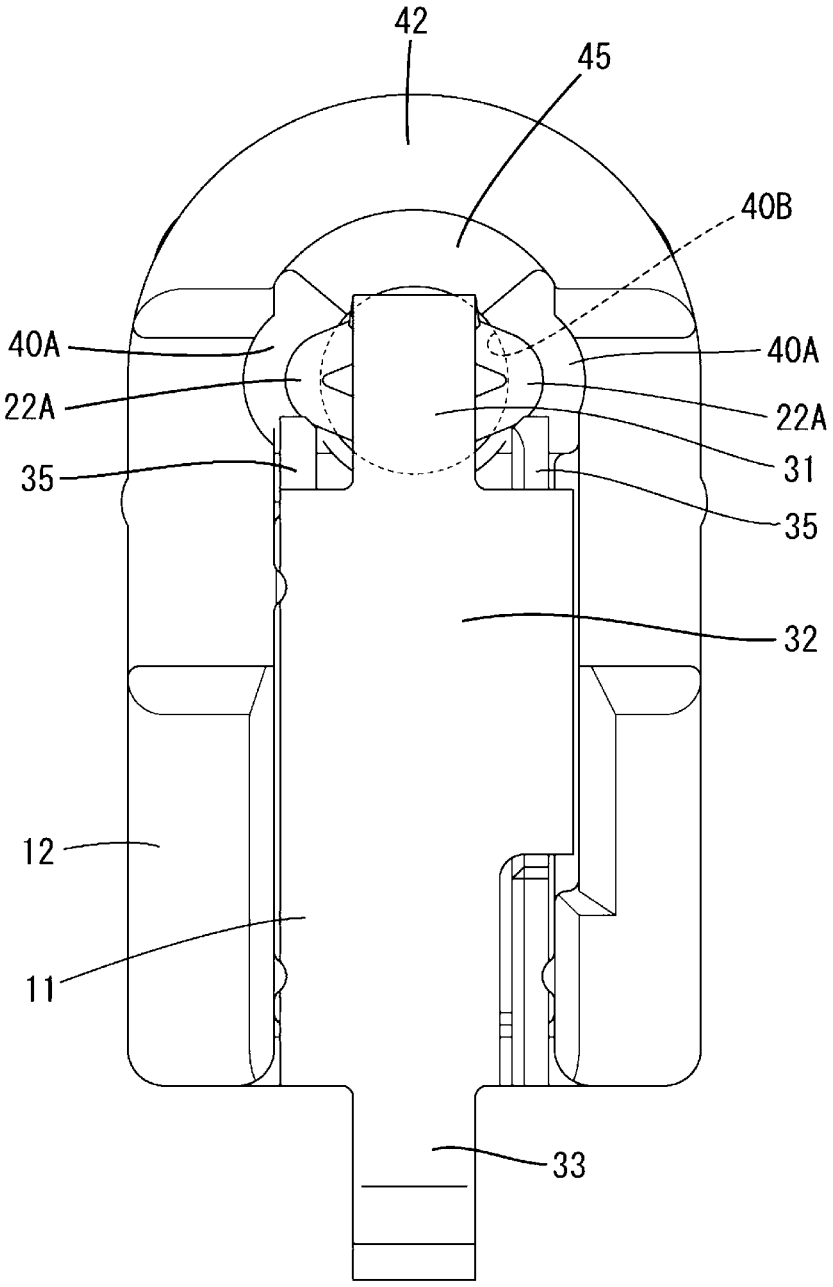
FIG. 4 is a back view showing a state where the inner conductor terminal is locked to a dielectric.

The dielectric 12 is made of synthetic resin. As shown in FIGS. 1 and 2, the dielectric 12 is arranged between the inner conductor terminal 11 and the outer conductor terminal 13. The dielectric 12 includes a dielectric body 40, a first wall portion 41, a second wall portion 42 and a protruding portion 44. The dielectric body 40 is in the form of a tube, particularly a hollow cylinder, open in the front-rear direction. The first wall portion 41 is connected to a lower part of the rear end of the dielectric body 40 and covers a front side of the rectangular tube portion 32. The second wall portion 42 is connected to the rear ends of the dielectric body 40 and the first wall portion 41 and covers upper, left and right sides of the bent portion 31 and the rectangular tube portion 32. The protruding portion 44 protrudes rearward from an upper part of a rear surface 40A of the dielectric body 40 inside the second wall portion 42. The rear surface of the protruding portion 44 is configured as a reference surface 45. The reference surface 45 is arranged to be retracted forward from the rear end of the second wall portion 42. The reference surface 45 is arranged at a position aligned with rear surfaces 22A of the rear projections 22 in the front-rear direction with the rear projections 22 of the inner conductor terminal 11 locked to the dielectric 12. Both left and right ends of the reference surface 45 are arranged laterally outwardly of both left and right ends of the bent portion 31 of the inner conductor terminal 11 (FIG. 4). The dielectric 12 does not cover the rear surface of the inner conductor terminal 11. That is, the rear side of the inner conductor terminal 11 is exposed on the rear surface of the dielectric 12.

The dielectric body 40 covers the outer periphery of the terminal body 20 of the inner conductor terminal 11. The dielectric body 40 is formed with a through hole 40B penetrating in the front-rear direction. The terminal body 20 inserted from behind is arranged in the through hole 40B. The front and rear projections 21, 22 provided on the terminal body 20 are locked to the inner peripheral surface of the through hole 40B. The front projections 21 are arranged in a central part in the front-rear direction of the dielectric body 40. The rear projections 22 are arranged in a rear end part of the dielectric body 40. The rear ends of the rear projections 22 are arranged behind the rear surface 40A of the dielectric body 40.

The outer conductor terminal 13 is a part for covering the outer periphery of the inner conductor terminal 11 and integrally formed, such as by bending a conductive metal plate. The outer conductor terminal 13 includes an outer conductor terminal body 50, a first ground connecting portion 51, a second ground connecting portion 52, an inner locking portion 53, an outer locking portion 54 and a restricting portion 55. The outer conductor terminal body 50 is in the form of a tube, particularly a hollow cylinder, open in the front-rear direction. The outer conductor terminal body 50 covers the outer periphery of the terminal body 20 of the inner conductor terminal 11 via the dielectric body 40 of the dielectric 12. The first and second ground connecting portions 51, 52 are respectively connected to ground conductive paths of the board 90. The inner locking portion 53 projects inwardly of the outer conductor terminal body 50. The inner locking portion 53 is locked to the dielectric body 40 of the dielectric 12 inserted into the outer conductor terminal body 50 from behind. The outer locking portion 54 projects outwardly of the outer conductor terminal body 50. The restricting portion 55 projects outwardly of the outer conductor terminal body 50 behind the outer locking portion 54.

The housing 14 is made of synthetic resin. The housing 14 includes a mounting portion 60 and a receptacle 61. The outer conductor terminal 13 is mounted into the mounting portion 60. The mounting portion 60 is formed with a mounting hole 62 penetrating through the mounting portion 60 in the front-rear direction. The outer conductor terminal 13 is inserted into the mounting hole 62 from behind to be mounted. In particular, the outer locking portion 54 of the outer conductor terminal 13 is locked to the inner peripheral surface of the mounting hole 62. A forward displacement of the outer conductor terminal 13 is restricted by the restricting portion 55 of the outer conductor terminal 13 butting against the rear surface of the mounting portion 60. The receptacle 61 is in the form of a tube, particularly a rectangular tube, projecting forward from the outer periphery of the mounting portion 60. The inside of the receptacle 61 is open forward. Mounting grooves 63 are formed in both left and right sides of the housing 14. The mounting members 15 made of metal are mounted in the respective mounting grooves 63. The connector 10 is mounted on the board 90 via the mounting members 15.

Next, functions and effects of the connector 10 are described.

In the connector 10, the terminal body 20 of the inner conductor terminal 11 is inserted into the through hole 40B of the dielectric 12 from behind. Then, the front and rear projections 21, 22 provided on the terminal body 20 are respectively locked to the inner peripheral surface of the through hole 40B. The front and rear projections 21, 22 are locked to the dielectric 12 at the same height position. In this way, the terminal body 20 is locked to the dielectric 12 at two positions spaced apart in the front-rear direction. Therefore, the inner conductor terminal 11 is less likely to be inclined with the front or rear projections 21, 22 as a fulcrum in the dielectric 12.

Further, the rear surfaces 22A of the rear projections 22 are exposed on the rear end of the inner conductor terminal 11. Thus, the inner conductor terminal 11 can be press-fit into the dielectric 12 by pushing the rear surfaces 22A of the rear projections 22 from behind by a jig or the like. That is, the rear surfaces 22A of the rear projections 22 can function as a pressing surface. Thus, a configuration can be simplified as compared to a configuration formed with a part having a pressing surface separately from the rear projections 22.

Further, the dielectric 12 has the reference surface 45 aligned in position with the rear surfaces 22A of the rear projections 22 in the front-rear direction in a state where the inner conductor terminal 11 is locked. Thus, in locking the inner conductor terminal 11 by press-fitting the inner conductor terminal 11 into the dielectric 12, the inner conductor terminal 11 can be easily positioned in a press-fitting direction of the inner conductor terminal 11 by pushing the jig until a surface of the jig pushing the rear projections 22 butts against the reference surface 45.

Further, the rear projections 22 are formed by causing parts of the terminal body 20 to project radially outwardly. According to this configuration, the rear projections 22 can be formed by bending and raising parts of the terminal body 20, wherefore the rear projections 22 are easily formed.

Further, the inner conductor terminal 11 includes the bent portion 31 connected to the rear end of the terminal body 20 and bent to cover a rear opening of the terminal body 20. The rear projections 22 are provided to protrude on both sides across the bent portion 31. According to this configuration, the rear projections 22 can be pressed from both sides across the bent portion 31. Thus, the posture of the inner conductor terminal 11 is easily stabilized and the inner conductor terminal 11 is easily press-fit in the process of press-fitting the inner conductor terminal 11 into the dielectric 12.

Other Embodiments of Present Disclosure

The embodiment disclosed this time should be considered illustrative in all aspects, rather than restrictive.

(1) Although the projections are provided at two front and rear positions of the terminal body in the above embodiment, projections may be provided at three or more positions.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

an inner conductor terminal;

an outer conductor terminal for covering an outer periphery of the inner conductor terminal; and a dielectric arranged between the inner conductor terminal and the outer conductor terminal, wherein:

the inner conductor terminal includes a tubular terminal body extending in a front-rear direction and projections provided on the terminal body and to be locked to the dielectric, a plurality of the projections are provided at an interval in the front-rear direction, and a rear end of a rear projection is arranged behind a rear surface of the dielectric, the rear projection being the projection arranged at a rearmost position, out of the plurality of projections provided at an interval in the front-rear direction.

2. The connector of claim 1, wherein the rear projection is exposed on a rear end of the inner conductor terminal.

3. The connector of claim 2, wherein the dielectric has a reference surface aligned in position with a rear surface of the rear projection in the front-rear direction in a state where the inner conductor terminal is locked.

4. The connector of claim 2, wherein the rear projection is formed by causing a part of the terminal body to project radially outwardly.

5. The connector of claim 2, wherein:

the inner conductor terminal includes a bent portion connected to a rear end of the terminal body and bent to cover a rear opening of the terminal body, and the rear projection is provided to protrude on both sides across the bent portion in a back view.

* * * * *